US005899508A

United States Patent [19]

Cetnar et al.

[11] Patent Number: 5,899,508

[45] Date of Patent: May 4, 1999

[54] DOUBLE LOCKING VEHICLE DOOR LATCH

[75] Inventors: Roman Cetnar, Newmarket; Kris Tomaszewski, Concord, both of Canada

[73] Assignee: Atoma International Inc., Newmarket, Canada

[21] Appl. No.: 08/914,161

[22] Filed: Aug. 19, 1997

[51] Int. Cl.[6] ..... E05C 3/06

[52] U.S. Cl. ..... 292/216; 292/DIG. 23

[58] Field of Search ..... 292/201, 216, 292/DIG. 23, DIG. 27, 336.3

[56] References Cited

U.S. PATENT DOCUMENTS

| | | | |
|---|---|---|---|
| 3,998,482 | 12/1976 | Nozaki | 292/216 |
| 4,342,209 | 8/1982 | Kleefeldt | 70/264 |
| 4,492,395 | 1/1985 | Yamada | 292/216 |
| 4,921,286 | 5/1990 | Nakamura | 292/216 |
| 5,092,638 | 3/1992 | Mizuki | 292/216 |
| 5,236,234 | 8/1993 | Norman | 292/201 |
| 5,438,855 | 8/1995 | Ikeda | 70/279 |
| 5,474,339 | 12/1995 | Johnson | 292/216 |
| 5,577,583 | 11/1996 | O'Donnell | 292/336.3 |
| 5,577,782 | 11/1996 | Johnson | 292/216 |

*Primary Examiner*—Steven Meyers
*Assistant Examiner*—Gary Estremsky
*Attorney, Agent, or Firm*—Pillsbury, Madison & Sutro L.L.P.

[57] ABSTRACT

A door latch assembly has a housing defining a mouth. A detent fork is pivotally mounted within the housing to cooperate with the mouth to pivot between an open and closed condition for receiving, engaging and cinching a keeper of a striker. The detent fork is biased in the open condition. A pivotally mounted pawl is biased into engagement with the detent fork for retaining the detent fork in the closed condition. A pivotally mounted inside release lever is movable between a stand-by position and a release position and biased to the stand-by position. A pivotally mounted outside release lever is movable between a stand-by position and a release position, and biased to the stand-by position. A pivotally mounted locking cam operably engages the pawl for positioning the pawl to selectively engage the release levers. The locking cam is rotatable between an unlocked position for urging the pawl to engage at least one of the levers, a single lock position for urging the pawl to engage at most one of the levers, and a double lock position for urging the pawl to disengage both levers. A double lock lever operably engages the rotatable locking cam for rotating the locking cam between the unlocked position, the single lock position and the double lock position. A single lock subassembly is coupled to the rotatable locking cam for rotation therewith between the unlocked position and the single lock position and uncoupled from the rotating locking cam when the rotatable locking cam is rotated between the single lock position and the double lock position.

10 Claims, 8 Drawing Sheets

DOUBLE LOCKING VEHICLE DOOR LATCH

FIELD OF INVENTION

This invention relates to a latch for a vehicle door. In particular, this invention relates to a latch having an increased level of security for a vehicle by selectively disabling the release and inside locking mechanism of the latch.

BACKGROUND OF INVENTION

Vehicle door latch systems are well known in the art. Typically, a vehicle door will have a latch for engaging and cinching onto a striker. The door will have an inside handle and an outside handle for releasing the latch and opening the door. Additionally, the door will have a lock for preventing the door from being opened by either the inside handle or the outside handle or both. For selected doors, the door is provided with a key cylinder for locking and unlocking the doors.

Optionally, vehicles can be provided with a power option. Each door latch is provided with a servo-actuator for locking and unlocking the door latches. The servo-actuators are electrically connected to a common station for effecting selected and ganged operation of the locks. The common station is now usually provided with a receiver which responds to a transmitter for remotely locking and unlocking the doors.

Additionally, rear doors are commonly provided with a lever for disabling the inside door handle for child proofing the vehicle.

Notwithstanding the ability to lock or disable the doors of the vehicle, the vehicle is still susceptible to theft by the use of a tool known as a "slim-jim". The "slim-jim" tool is inserted between the window and the window seal to manipulate the connecting rods between the looking lever or the release handle and the door latch. The "slim-jim" tool will either unlock or open the door allowing the thief access to the vehicle.

In order to increase the security level of the vehicle, some manufacturers have resorted to incorporating a dead bolt or double lock into the latch assemblies. The double lock feature disables the inside locking levers and release handles of each door making the "slim-jim" tool ineffective. Additionally if the thief were to break the window to gain entry, the thief would not be able to open any other doors and would thus be required to exit through the broken window.

Examples of such dead bolt or double lock devices are described in the following patents and publications: U.S. Pat. Nos. 4,342,209; 4,921,286; 4,492,395; 5,092,638; 5,438,855 and Japanese patent application no. JP94200101.

The prior art double lock devices generally require complex linkages and assemblies. As a result, the double lock feature cannot easily be added to a vehicle during assembly. Thus, the feature has only been available only limited luxury vehicles.

SUMMARY OF THE INVENTION

The disadvantages of the prior art may be overcome by providing an assembly for a vehicle door latch having a double lock feature which can be easily activated during vehicle assembly.

It is desirable to provide a door latch assembly which has an inside locking single lever and a double locking lever which are independently rotatable between an unlock and a single lock condition. The inside locking lever can be disengaged or disabled as the double locking lever is rotated between a single lock condition and a double lock condition.

It is desirable to provide an inside locking lever sub-assembly having an arm and a handle rotatably mounted on a common shaft. The handle is connectable to an inside locking control. The arm and handle are biased together and have complementary engagement surfaces. The handle can be coupled to the arm for rotating the locking cam between the unlock and the single lock condition. The handle is uncoupled from the arm as the locking cam is rotated between a single lock condition and a double lock condition.

According to one aspect of the invention, there is provided a door latch assembly having a housing defining a mouth. A detent fork is pivotally mounted within the housing to cooperate with the mouth to pivot between an open and closed condition for receiving, engaging and cinching a keeper of a striker. The detent fork is biased in the open condition. A pivotally mounted pawl is biased into engagement with the detent fork for retaining the detent fork in the closed condition. A pivotally mounted inside release lever is movable between a stand-by position and a release position and biased to the stand-by position. A pivotally mounted outside release lever is movable between a stand-by position and a release position, and biased to the stand-by position. A pivotally mounted locking cam operably engages the pawl for positioning the pawl to selectively engage the release levers for rotating between the stand-by and release positions. The locking cam is rotatable between an unlocked position for urging the pawl to engage at least one of the levers, a single lock position for urging the pawl to engage at most one of the levers, and a double lock position for urging the pawl to disengage both levers. A double lock lever operably engages the rotatable cam for rotating the cam between the unlocked position, the single lock position and the double lock position. A single lock sub-assembly is coupled to the rotatable locking cam for rotation therewith between the unlocked position and the single lock position and uncoupled from the rotating locking cam when the rotatable locking cam is rotated between the single lock position and the double lock position.

According to another aspect of the invention, there is provided a single lock sub-assembly having a handle and an arm. The handle and arm each have a cam surface having complementary ramp surfaces for coupled cooperative movement therebetween when a locking cam is rotated between the unlock position and the single lock position. The ramp surfaces urges the handle and locking arm apart for uncoupled relative sliding movement when the locking cam is rotated between the single lock position and double lock position.

According to another aspect of the invention, there is provided a single lock sub-assembly having an abutment for limiting rotation of a handle in a locking sense when the rotatable locking cam is rotated from the single lock position to the double lock position. A spring urges the handle into engagement with a locking arm. Additionally, the spring urges the handle in the locking sense when the rotatable locking cam is rotated between the single lock position to the double lock position. When the handle overcomes the inside spring bias upon uncoupling from the locking arm, the outside spring bias urges the handle to rotate to a single lock or standby position.

According to another aspect of the invention, there is provided a double locking door latching system for a door of a vehicle. The system has an inside release handle, an outside release handle, an inside door lock lever, a key locking mechanism for single locking, double locking and unlocking the door and a power lock system, and a door latch assembly. The power lock system switches the door between a single lock, a double lock and an unlocked condition. The power lock system has a receiver for receiving signals and responsively switching the door between the single lock, double lock and unlocked conditions. The door latch assembly has a housing having a mouth. A detent fork is pivotally mounted within the housing to cooperate with the mouth to pivot between an open and closed condition for receiving, engaging and cinching a keeper of a striker. The detent fork biased in the open condition. A pivotally mounted pawl is biased for biasing the pawl into engagement with the detent fork for retaining the detent fork in the closed condition. A pivotally mounted inside release lever is operably connected to the inside release handle. The inside release lever is movable between a stand-by position and a release position and biased to the stand-by position. A pivotally mounted outside release lever is operably connected to the outside release handle. The outside release lever is movable between a stand-by position and a release position and biased to the stand-by position. A pivotally mounted locking cam operably engages the pawl for positioning the pawl to selectively engage the release levers. The locking cam is rotatable between an unlocked position for urging the pawl to engage at least one of the levers, a single lock position for urging the pawl to engage at most one of the levers, and a double lock position for urging the pawl to disengage both levers. A double lock lever is operably connected to the key locking mechanism. The double locking lever operably engages the rotatable locking cam for rotating the locking cam between the unlocked position, the single lock position and the double lock position. A single lock assembly is operably connected to the inside door lock lever. The single lock assembly is coupled to the rotatable locking cam for rotation therewith between the unlocked position and the single lock position and uncoupled from the rotating locking cam when the rotatable locking cam is rotated between the single lock position and the double lock position. An actuator is operably connected to the power lock mechanism. The operably engages the locking cam for driving rotation therewith.

DESCRIPTION OF THE DRAWINGS

In drawings which illustrate embodiments of the invention.

DESCRIPTION OF THE INVENTION

Figure 1:
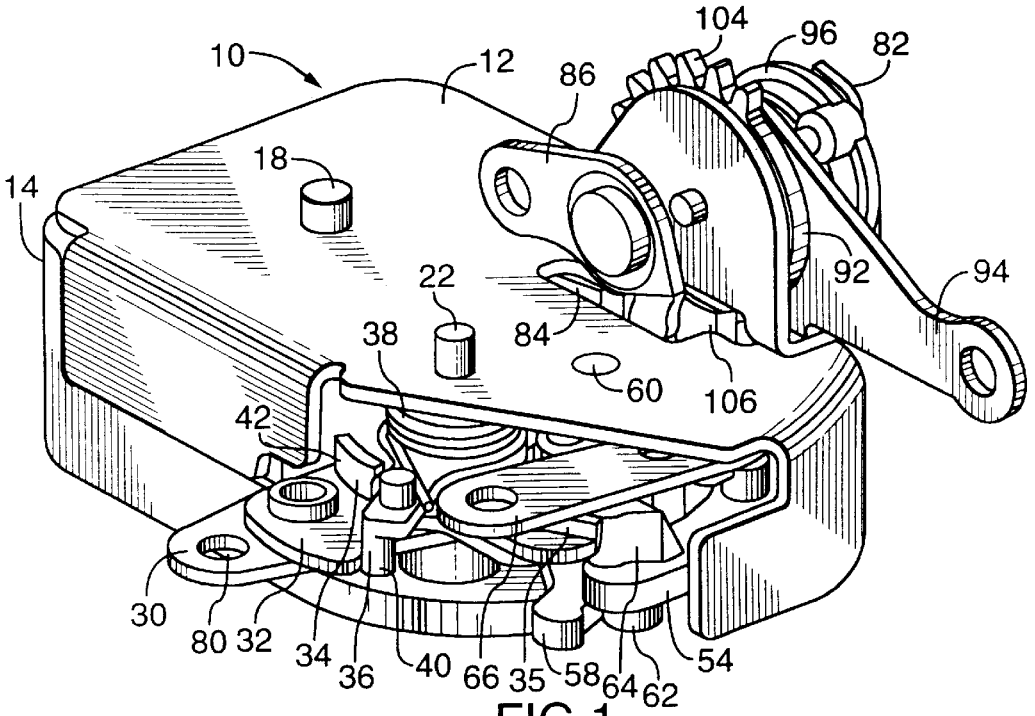
FIG. 1 is a perspective view of the latch assembly of the present invention.
Figure 2:
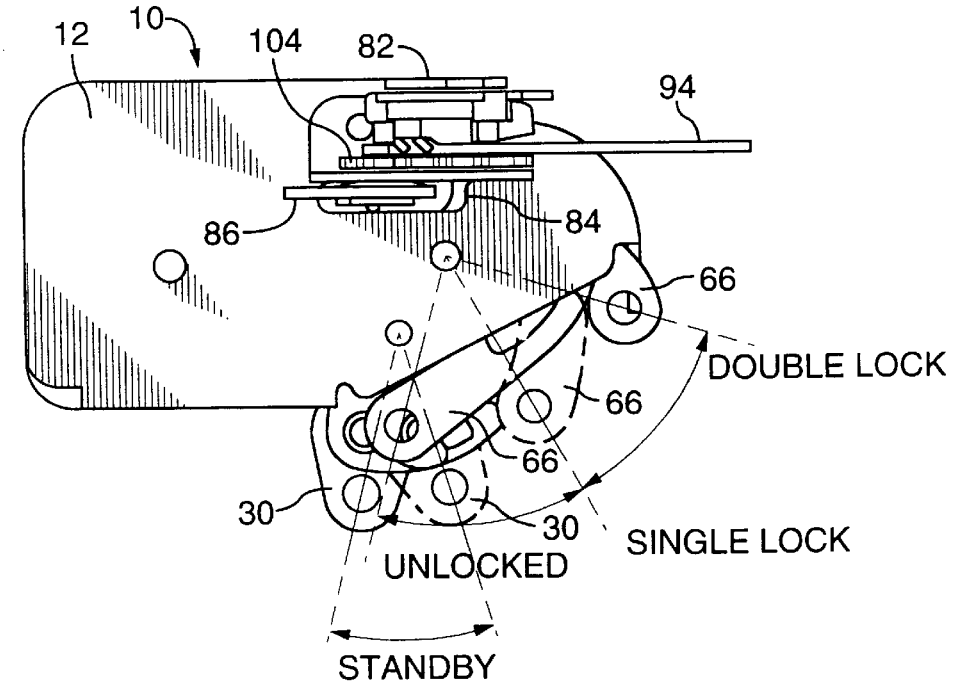
FIG. 2 is a top plan view of the latch assembly of FIG. 1.
Figure 3:
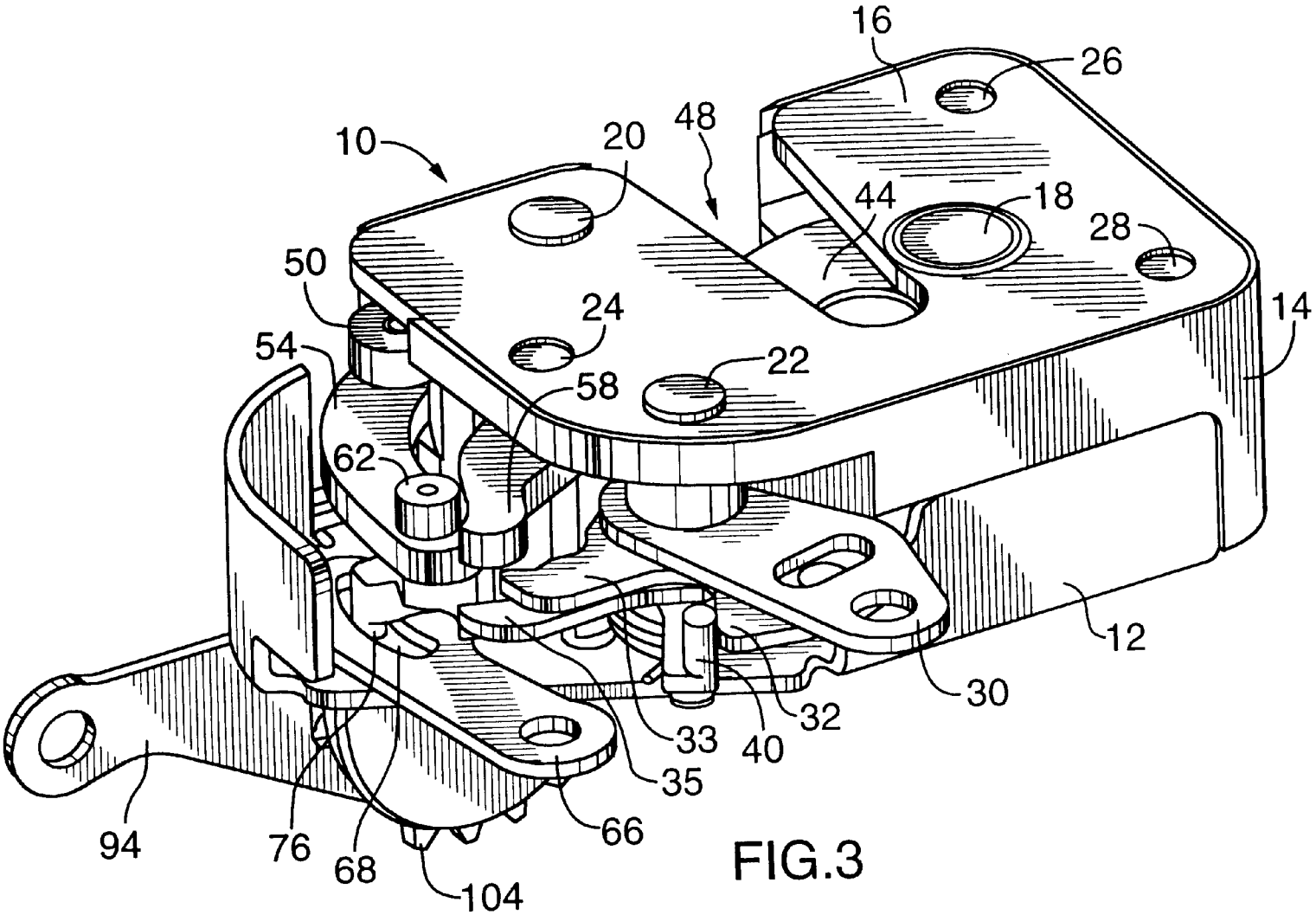
FIG. 3 is a perspective view of the underside of the latch assembly of FIG. 1.

Referring generally to FIGS. 1 to 3, a latch assembly 10 of the present invention is illustrated. The latch assembly 10 generally comprises a cover plate 12, a housing 14 and a latch plate 16. Pins 18, 20 and 22 extend from latch plate 16 through housing 14 and terminate at cover plate 12 to define three axes about which other parts as described below pivotally move. Latch plate 16 has a plurality of threaded bores 24, 26 and 28 which are used to attach the assembly 10 to a door of a vehicle.

Figure 4:
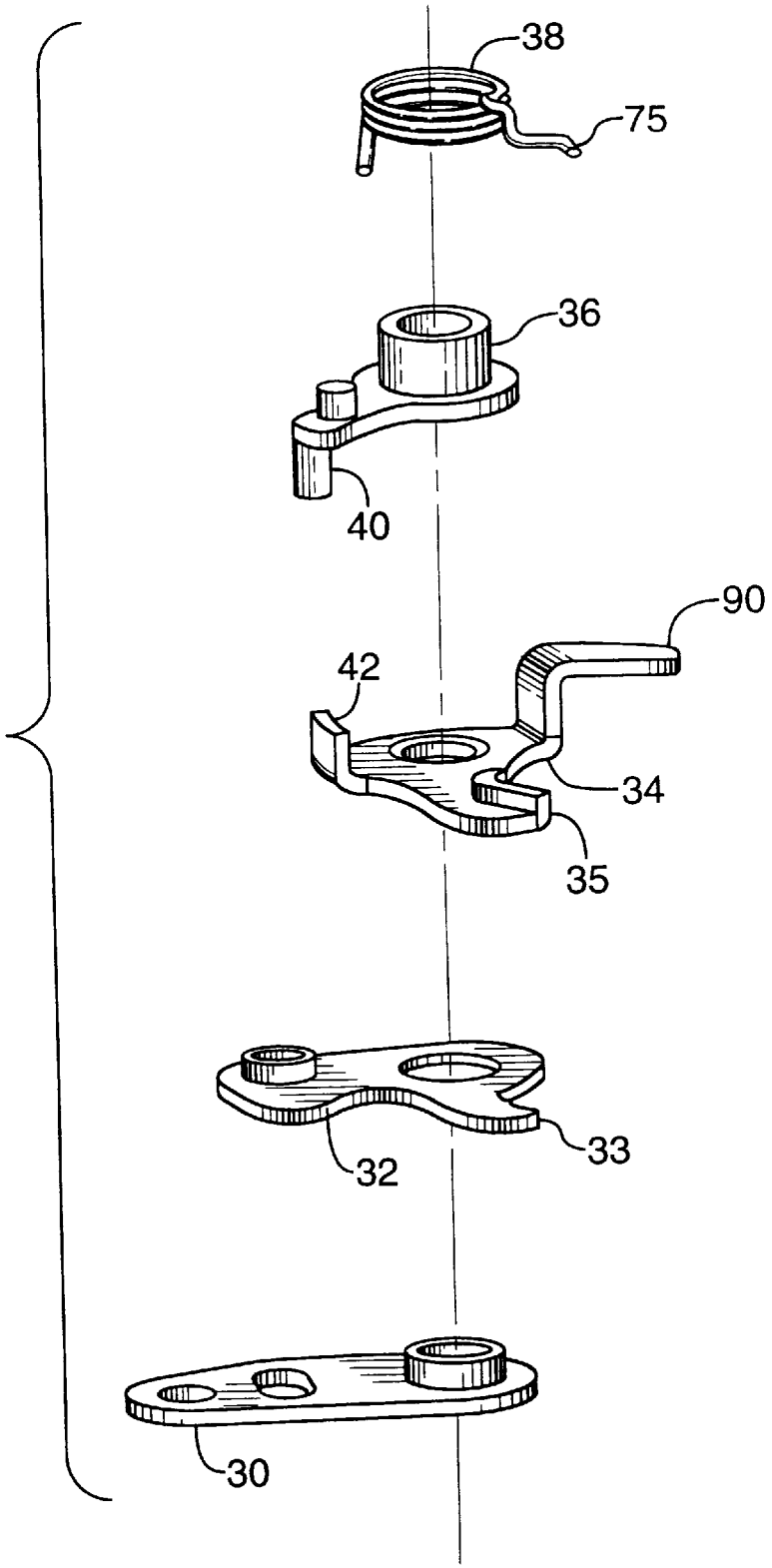
FIG. 4 is an exploded perspective view of the release arm sub-assembly of the latch assembly of FIG. 1.

Referring additionally to FIG. 4, outside release lever 30 and outside release arm 32 are rotatably mounted on pin 22 and fastened together for cooperative movement between a stand-by position and a release position. Inside release lever 34 is rotatably mounted on pin 22 and rotatable between a stand-by position and a release position. Biasing mount 36 is rotatably mounted on pin 22. Spring 38 biases mount 36 to a standby position. Biasing mount 36 has an abutment 40 for engaging outside release lever 30. Inside release lever 34 has an abutment 42 extending axially for engaging mount 36. Spring 38 will operably bias both outside release lever 30 and inside release arm 34 to a standby position.

Outside release arm 32 has a tab 33 extending radially. Inside release lever 34 has a tab 35 extending radially. Preferably, outside tab 33 and inside tab 35 generally extend in the same direction and outside tab 33 is shorter than inside tab 35.

Figure 6:
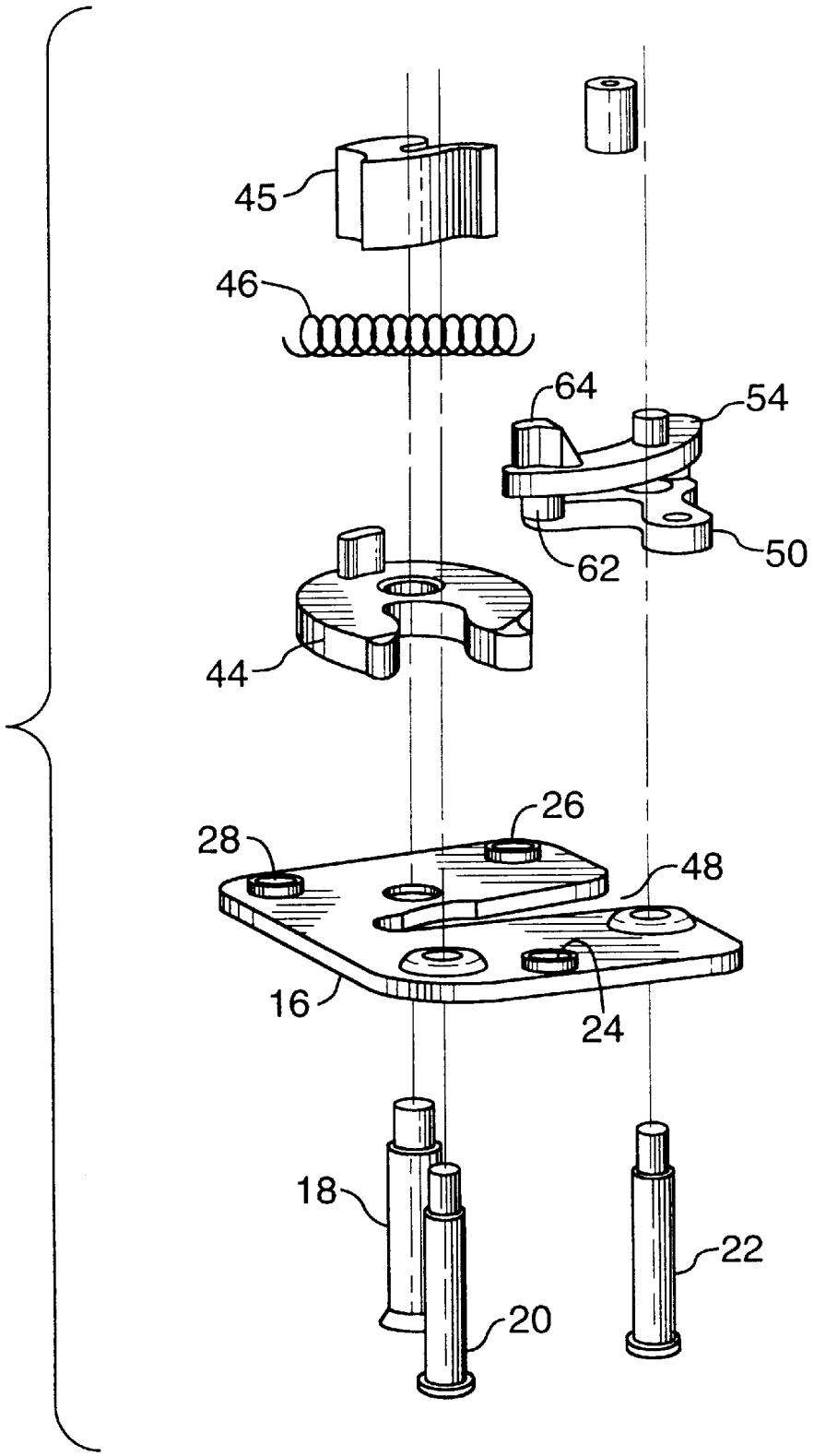
FIG. 6 is an exploded perspective view of the detent fork and pawl sub-assembly of the latch assembly of FIG. 1.

Referring additionally to FIG. 6, detent fork 44 is rotatably mounted on pin 18. Overslam bumper 45 is positioned to absorb energy of impact between the latch assembly 10 and the keeper of the striker, i.e. when the door is slammed closed. Spring 46 biases detent fork 44 to an open condition. Detent fork 44 is generally U-shaped. Detent fork 44 cooperates with the mouth 48 of housing 14 and to move between an open condition, a latched position and a cinched position to receive, grasp and cinch onto a keeper of a striker in a manner well known in the art.

Pawl 50 is rotatably mounted onto pin 22. Spring 52 biases pawl 50 into the path of travel of detent fork 44. In a manner well know in the art of latches, pawl 50 cooperates with the detent fork 44 in a ratchet and pawl relation. Pawl 50 is generally V-shaped having two arms. Pawl 50 is rotatably mounted at the bight of the V. One of the arms extends into the path of travel of the detent fork 44. The other arm has an engagement arm 54 pivotally mounted at the distal end remote from the bight. Spring 52 also biases engagement arm 54 to extend abutment 64 into the path of travel of outside tab 33 of outside release arm 32 and inside tab 35 of inside release lever 34 to selectively engage therewith.

Figure 5:
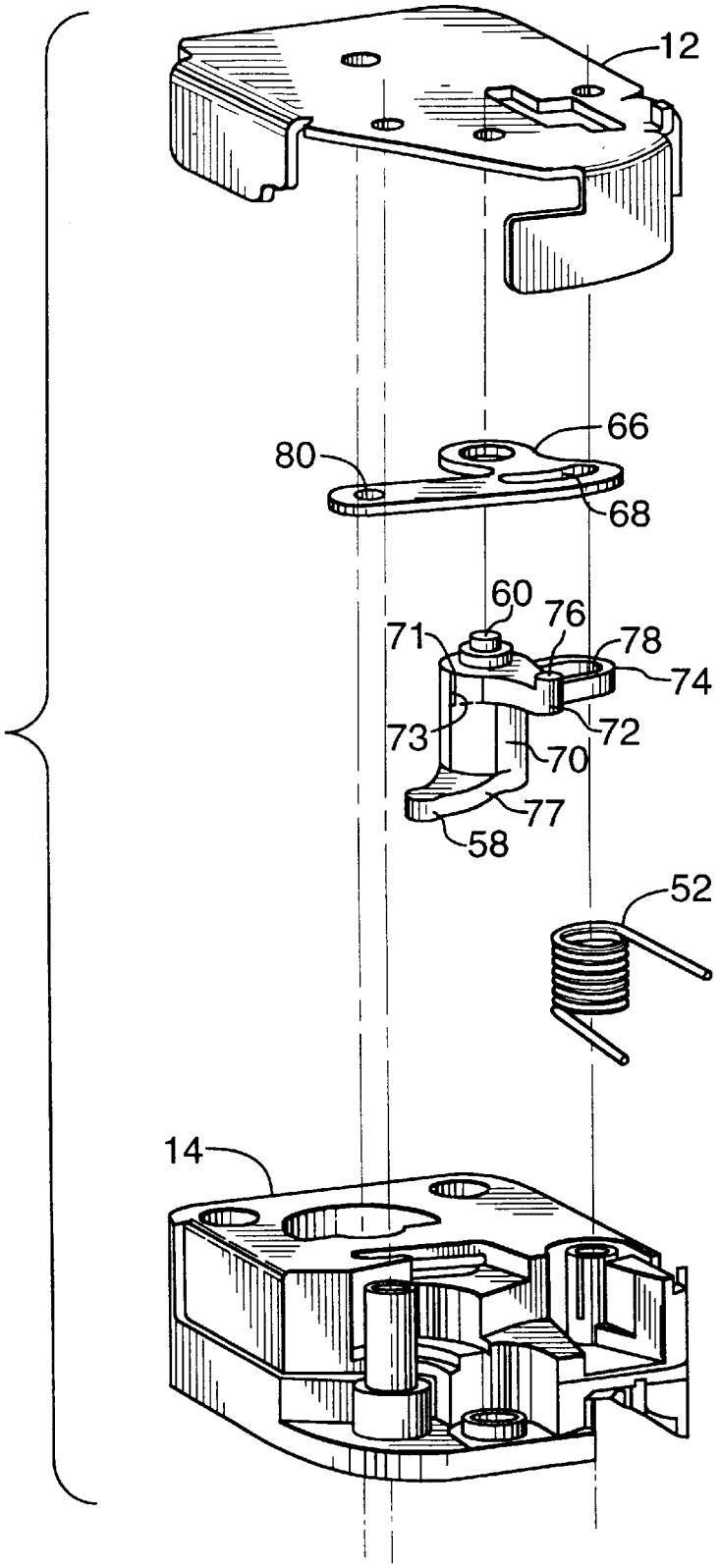
FIG. 5 is an exploded perspective view of the locking cam sub-assembly of the latch assembly of FIG. 1.

Referring additionally to FIG. 5, locking cam 58 is rotatably mounted on pin 60. Locking cam 58 has a cylindrical body 70, an outside tab 72 and an inside tab 74. Outside tab 72 has an abutment 76 extending axially. Inside tab 74 has a slot 78. Locking cam 58 is rotatable and has an unlocked position, a single locked position and a double locked position. The remote end of engagement arm 54 has an axially extending abutment 62 which frictionally engages locking cam 58 along cam surface 77.

Locking lever 66 is mounted on pin 60. Locking lever 66 has a generally L-shape. The distal end of the base is the pivot point for the locking lever 66. A slot 68 extends along the stem of the L. The remote end 80 connects to a key lock cylinder. Slot 68 receives tab 76 in a sliding relation. Locking lever 66 is rotatable and has an unlocked position, a single lock position and a double lock position as illustrated in FIG. 2, which corresponds to the positions of the locking cam 58.

Body 70 has a pair of longitudinally extending detents 71 and 73 which extend from outside tab 72. Spring 38 has a notched end 75 which engages body 70 at the detents 71 and 73. Detents 71 and 73 are positioned to correspond with the rotational position of locking cam 58 for an unlocked position, a single lock position and a double lock position. Body 70 will rotate between the unlocked position, single lock position and double lock position in a stepped manner.

Figure 7:
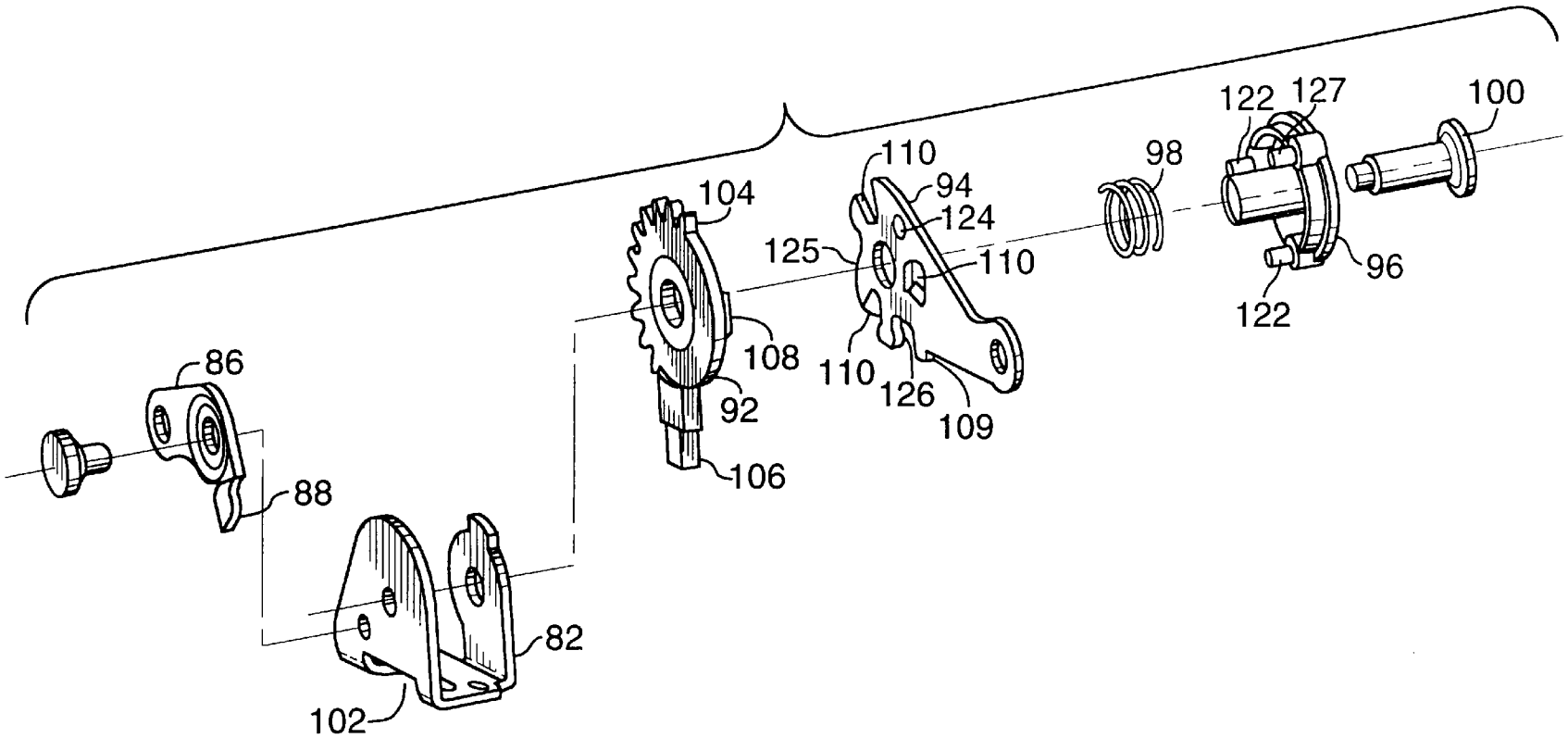
FIG. 7 is an exploded perspective view of the single lock sub-assembly of the latch assembly of FIG. 1.

Referring additionally to FIG. 7, the single lock subassembly is illustrated. The single lock assembly has a U-shaped bracket 82 mounted on the outside of cover plate 12 adjacent slot 84. Inside release lever 86 is pivotally mounted onto bracket 82. The axis of rotation of release lever 86 is orthogonal to the axes of rotation of pins 18, 20 and 22. Inside release lever 86 is L-shaped. The base 88 extends into the housing of latch 10 to engage tab 90 of inside release lever 34. Pivotal movement of inside release lever 86 effects rotational movement of inside release lever 34 against the bias of spring 38.

Inside locking arm 92, handle 94, spring mount 96 and spring 98 are commonly mounted on pin 100 for rotation thereabout. Pin 100 is mounted and secured onto bracket 82. Spring 98 biases spring mount 96 in a locking sense about pin 100. Bracket 82 has a slot 102 through which inside locking arm 92 communicates to extend into the interior of the door latch 10.

Spring mount 96 has an abutment for engaging tab 83 of the bracket 82 for limiting rotation for a locking sense. Locking arm 92 has a disc portion having a series of gear teeth 104 for engaging an actuator of a power door locking system and a radially extending tab 106. Tab 106 engages slot 78 of inside tab 74. Rotation of locking arm 92 will cause rotation of locking cam 58.

Figure 8:
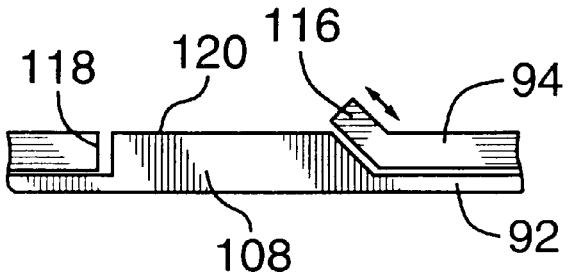
FIG. 8 is an end view of the handle and locking arm in a coupled condition of the single lock sub-assembly of FIG. 7.
Figure 9:
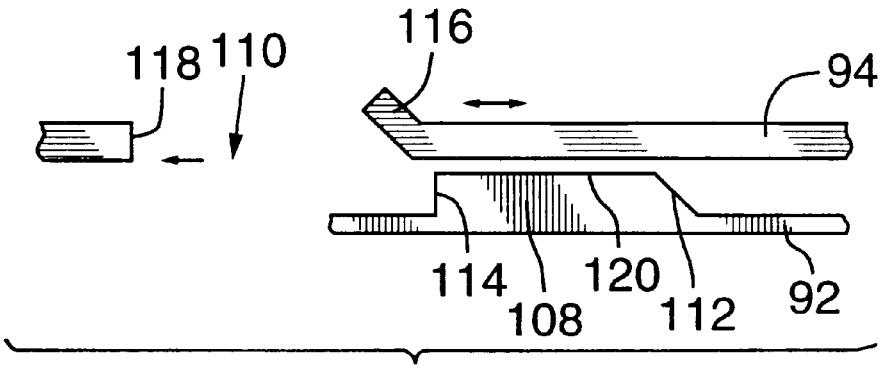
FIG. 9 is an end view of the handle and locking arm in an uncoupled condition of the single lock sub-assembly of FIG. 7.

Referring to FIGS. 8 and 9, locking arm 92 has a series of circumferentially spaced ramps 108 which interengage with complementary slots 110 of handle 94. Ramp 108 has a sloped face 112 and an abutment face 114. Similarly, slot 110 has a sloped ramp formed by tab 116 and an abutment face 118. The ramps 108 are sized to be fully registered within slots 110. When the ramps 108 are fully registered, the locking arm 92 and handle 94 are coupled and will rotate together.

Handle 94 has an abutment 109 which engages the bracket 82 to limit the travel of the handle allowing the locking arm 92 to rotate in a locking sense to move from a single lock to a double lock position. The sloped ramp of tab 116 will move along the sloped ramp of sloped face 112 once the bias of spring 98 has been overcome. Once the handle 94 and locking arm 92 have traveled the length of the slope, the face of handle 94 will slidingly engage the bearing surface 120 of ramp 108.

Spring mount 96 has a series of pilot pins 122 which extend axially. Handle 94 has a pilot bore 124, a notch 125 and notch 126 which are aligned with pilot pins 122. As locking arm 92 is rotated in a locking sense taking the handle 94 out of coupled cooperative movement with the locking arm 92, the pilot bore 124, notch 125 and notch 126 of handle 94 will engage the pilot pins 122. Once out cooperative movement, the locking arm 92 can be independently rotated in a locking sense to the double lock position. In this condition, rotation of the handle 94 in an unlocking sense will not effect rotation of the locking arm 92. The bias of spring 98 will act against such rotation urging the handle 94 to rotate to the single lock position. The bias of spring 98 and the interengagement of the handle 94 and the spring mount 96 will hold the handle 94 stationary allowing the locking arm 92 to be counter-rotated in an unlocking sense from the double lock position to the single lock position. Once the respective ramp surfaces 116 and 112 are encountered, the locking arm 92 will snap into full registration with the handle 94 restoring cooperative movement.

Figure 10:
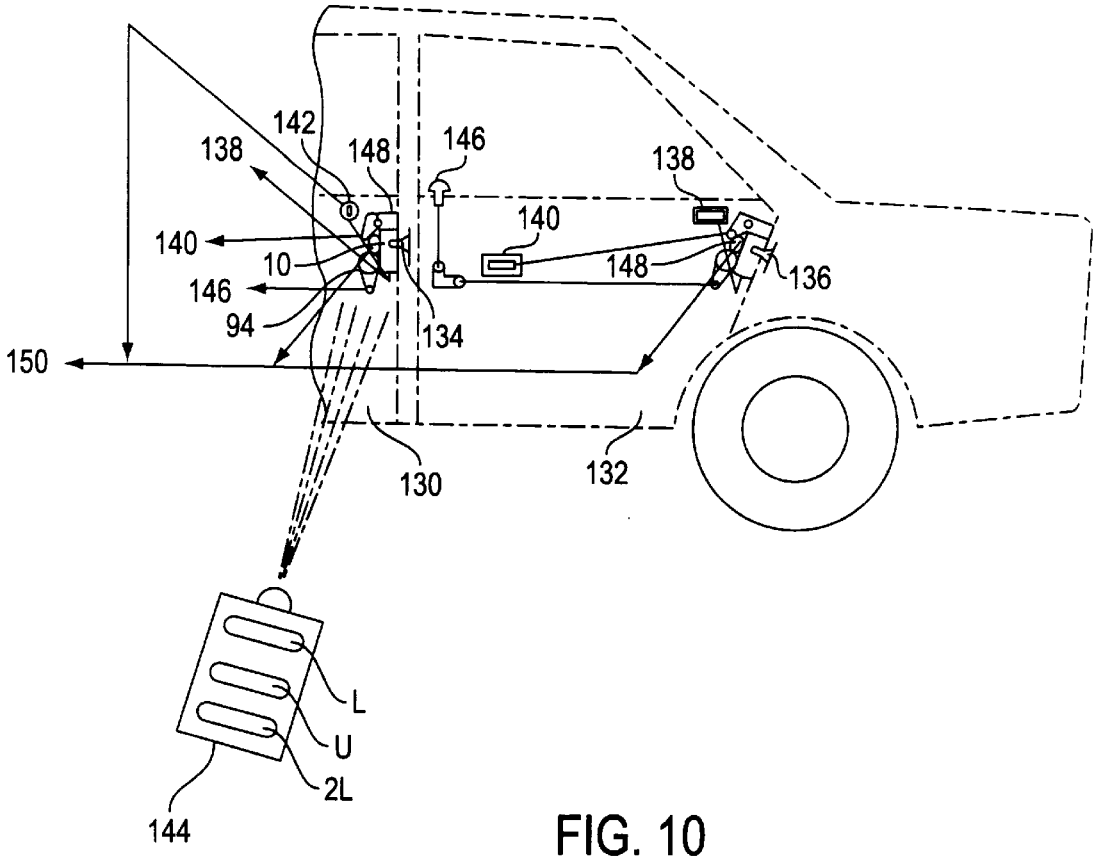
FIG. 10 is a side elevational view of a vehicle having a door lock system incorporating the latch assembly of FIG. 1.
Figure 11:
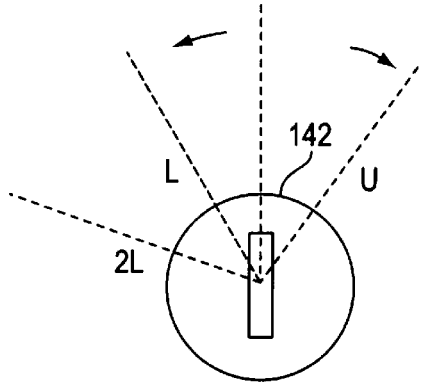
FIG. 11 is a schematic view of a locking cylinder of the door lock system of FIG. 10.

Referring to FIG. 10, the latch 10 of the present invention is installed on the rearwardly facing inside door face of a forward door 130 and rearward door 132 of a vehicle in a conventional manner and positioned to engage a keeper of strikers 134 and 136, respectively. Outside release arm 32 is linked to an outside door handle 138 for cooperative movement therewith. Similarly, inside release lever 34 is linked to an inside door handle 140.

Locking lever 66 of the driver's door 130 or front passenger door is cabled to an outside locking cylinder 142. Locking cylinder may be operable with a key, or a keypad and to a power lock system 150 having a receiver and a remote transmitter 144. Locking cylinder 142 preferably has four settings: unlocked U, neutral, single lock L and double lock 2L.

An actuator 148 mounted to engage teeth 104 of locking arm 92. In a manner well know in the art, the actuators 148 of each door are electronically connected together for separate or ganged operation from a central controller of power lock system 150.

Handle 94 is linked to an inside door lock handle and an inside power lock switch 146. The inside door lock handle and the inside power lock switch 146 has two settings: unlocked and single lock.

In use, the latch assembly 10 will function in a manner well known in the art when in the unlocked or single lock condition. In the unlocked condition, locking cam 58 will be positioned for full engagement of the engagement arm 54 with at least the outside release arm 32 or the inside release lever 34 or both. Rotation of either outside release arm 32 or the inside release lever 34, for the stand-by to the release positions, will effect rotation of the pawl 50 to release the detent fork 44.

Handle 94 is in full engagement with locking arm 92. Rotation of handle 94 will rotate the locking arm 92 and the locking cam 58 between the unlocked condition and the single lock condition. Similarly, outside locking lever 66 in rotatable between the unlocked condition and the single lock position to rotate locking cam 58 responsively.

In the single lock condition, locking cam 58 is rotated one step. Engagement arm 54 will be positioned for engagement with at most one release mechanism, preferably only the inside release lever 34. Optionally, the inside tab 35 of inside release lever 34 could be shorten so that it will not be engaged by the engagement arm 54 in the single lock condition, locking both the inside and outside.

In the double lock position, the operator either turns the key in the locking cylinder to a double lock position or activates a double lock button 2L on the remote transmitter 144. Locking lever 66 of the driver's door latch will cause the cam lever 58 to rotate one further step. Responsively, the power lock system 150 will energize the actuators 148 of all other doors to rotate locking arm 92 to cause the respective locking cam 58 to rotate to the double lock position.

Engagement arm 54 will be positioned out of the path of travel of both the outside release arm 32 and inside release lever 34. In this condition, a "slim-jim" is ineffective since movement of the release linkages cannot effect release of the door latch 10. Additionally, rotation of the locking cam 58 will effect rotation of the locking arm 92 relative to the handle 94, disengaging the two and disabling operation of the inside door locks. The actuators 148 will lock the door latches in the double lock condition. As a result, the only way to unlock the door latches 10 is via the key lock cylinder 142 or the power lock system 150.

The preceding specific embodiment is illustrative of the practice of the present invention. It is to be understood, however, that other expedients known or apparent to those skilled in the art or disclosed herein may be employed without departing from the spirit of the invention.

We claim:

1. A door latch assembly comprising:

a housing having a mouth, a detent fork pivotally mounted within the housing to cooperate with the mouth to pivot between an open and closed condition for receiving, engaging and cinching a keeper of a striker, the detent fork biased in the open condition, a pawl pivotally mounted on the housing, said pawl having biasing means for biasing the pawl into engagement with the detent fork for retaining the detent fork in the closed condition, said pawl having an actuation arm pivotally mounted thereon, an inside release lever pivotally mounted and movable between a stand-by position and a release position, said inside release lever having biasing means for biasing the inside release lever to the stand-by position, an outside release lever pivotally mounted and movable between a stand-by position and a release position, said outside release lever having biasing means for biasing the outside release lever to the stand-by position, a pivotally mounted locking cam constructed and arranged to operably engage the actuation arm of the pawl selectively engaging the release levers, said locking cam rotatable between an unlocked position wherein the locking cam urges the actuation arm to engage at least one of the levers whereby movement from the stand by position to the release position by the at least one of the levers rotates the pawl to release the detent fork, a single lock position wherein the locking cam urges the actuation arm to engage at most one of the levers whereby movement from the stand-by position to the release position by the at most one of the levers rotates the pawl to release the detent fork, and a double lock position wherein the locking cam urges the actuation arm to disengage both levers, a double lock lever pivotally mounted and constructed and arranged to operably engage the rotatable locking cam for rotating the locking cam between the unlocked position, the single lock position and the double lock position, said double lock lever connectable to an outside locking mechanism, and a single lock assembly comprising a pivotally mounted locking arm in operative engagement with the locking cam, a pivotally mounted handle slidably engaging the locking arm, said handle connectable to an inside locking mechanism, a pivotally mounted release arm operatively engaging said inside release lever, and a biasing means for urging the handle into engagement with the locking arm, the handle and the locking arm each having a cam surface having complementary ramp surfaces for selectively coupling and uncoupling the handle and locking arm together, wherein when the locking cam is in either the unlock position or single lock position, the handle and locking arm are coupled together enabling the handle to effect movement of the locking cam between the unlock position and the single lock position and when the locking cam is in the double lock position, the handle and locking arm are uncoupled allowing relative sliding movement therebetween disabling the handle from effecting movement of the locking cam.

2. A door latch assembly as claimed in claim 1 wherein the single locking assembly further comprises an abutment for limiting rotation of the handle in a locking sense when the rotatable locking cam is rotated from the single lock position to the double lock position.

3. A door latch assembly as claimed in claim 2 wherein said door latch assembly further comprises an actuator engaging said locking cam for driving rotation therewith.

4. A door latch assembly as claimed in claim 1 wherein said door latch assembly further comprises an actuator engaging said lock cam for driving rotation therewith.

5. A door latch assembly as claimed in claim 4 wherein the single locking assembly further comprises an abutment for limiting rotation of the handle in a locking sense when the rotatable locking cam is rotated from the single lock position to the double lock position.

6. A double locking door latching system for a door of a vehicle comprising:

an inside release handle;

an outside release handle;

an inside door lock lever;

a key locking means for single locking, double locking and unlocking said door;

a power lock means for switching the door between a single lock, a double lock and an unlocked condition, said power lock means having a receiver for receiving signals and responsively switching the door between the single lock, double lock and unlocked conditions; and a door latch assembly comprising:

a housing having a mouth, a detent fork pivotally mounted within the housing to cooperate with the mouth to pivot between an open and closed condition for receiving, engaging and cinching a keeper of a striker, the detent fork biased in the open condition, a pivotally mounted pawl having biasing means for biasing the pawl into engagement with the detent fork for retaining the detent fork in the closed condition, said pawl having an actuation arm pivotally mounted thereon, a pivotally mounted inside release lever operably connected to the inside release handle, said inside release lever movable between a stand-by position and a release position and biased to the stand-by position, a pivotally mounted outside release lever operably connected to the outside release handle, said outside release lever movable between a stand-by position and a release position and biased to the stand-by position, a pivotally mounted locking cam constructed and arranged to operably engage the actuation arm of the pawl selectively engaging the release levers, said locking cam rotatable between an unlocked position wherein the locking cam urges the actuation arm to engage at least one of the levers whereby movement from the stand by position to the release position by the at least one of the levers rotates the pawl to release the detent fork, a single lock position wherein the locking cam urges the actuation arm to engage at most one of the levers whereby movement from the stand-by position to the release position by the at most one of the levers rotates the pawl to release the detent fork, and a double lock position wherein the locking cam urges the actuation arm to disengage both levers, a double lock lever pivotally mounted and constructed and arranged to operably engage the rotatable locking cam for rotating the locking cam between the unlocked position, the single lock position and the double lock position, said double lock lever connectable to an outside locking mechanism, and a single lock assembly comprising a pivotally mounted locking arm in operative engagement with the locking cam, a pivotally mounted handle slidably engaging the locking arm, said handle connectable to an inside locking mechanism, a pivotally mounted release arm operatively engaging said inside release lever, and a biasing means for urging the handle into engagement with the locking arm, the handle and the locking arm each having a cam surface having complementary ramp surfaces for selectively coupling and uncoupling the handle and locking arm together, wherein when the locking cam is in either the unlock position or single lock position, the handle and locking arm are coupled together enabling the handle to effect movement of the locking cam between the unlock position and the single lock position and when the locking cam is in the double lock position, the handle and locking arm are uncoupled allowing relative sliding movement therebetween disabling the handle from effecting movement of the locking cam, and an actuator operably connected to the power lock means, said actuator engaging said locking cam for driving rotation therewith.

7. A double locking door latching system as claimed in claim 6 wherein the single locking assembly further comprises an abutment for limiting rotation of the handle in a locking sense when the rotatable locking cam is rotated from the single lock position to the double lock position, and a biasing means for urging the handle into engagement with the locking arm and for urging the handle in the locking sense when the rotatable cam is rotated between the single lock position to the double lock position.

8. The double locking door latching system as claimed in claim 6 wherein said actuator and said locking cam have complementary gears for engaging therewith in a geared relation.

9. The double locking door latching system as claimed in claim 6 wherein said power lock means is operably connected to said key lock means for responsively switching between the single lock, double lock and unlocked conditions.

10. The double locking door latching system as claimed in claim 6 wherein said power lock means is operably connected to the inside door lock lever and responsively switches between the single lock and unlocked conditions.

* * * * *